US005166467A

United States Patent [19]

Brown

[11] Patent Number: 5,166,467

[45] Date of Patent: Nov. 24, 1992

[54] FOOT PEDAL OPERATION OF AN ELECTRONIC SYNTHESIZER

[76] Inventor: Tommy M. Brown, 208 Juniper, Mansfield, Tex. 76063

[21] Appl. No.: 701,861

[22] Filed: May 17, 1991

[51] Int. Cl.[5] ..... G10H 1/34; G10H 1/38

[52] U.S. Cl. ..... 84/715; 84/721; 84/DIG. 22; 84/DIG. 25

[58] Field of Search ..... 84/600-602, 84/644, 645, 670, 718-721, 743-746, 613, 637, 650, 669, 715, 742, DIG. 22, DIG. 25

[56] References Cited

U.S. PATENT DOCUMENTS

| | | | |
|---|---|---|---|
| 3,962,945 | 6/1976 | Creager et al. | 84/DIG. 25 |
| 4,617,851 | 10/1986 | Sato | 84/601 X |
| 4,653,375 | 3/1987 | Honda et al. | 84/644 X |
| 4,700,604 | 10/1987 | Morikawa et al. | 84/645 X |

*Primary Examiner*—Stanley J. Witkowski
*Attorney, Agent, or Firm*—Charles W. McHugh

[57] ABSTRACT

A chord-generating synthesizer system including an electronic keyboard instrument and a remote control unit operable by a musician's foot—while the musician is using both hands to simultaneously play an instrument such as a guitar. The keyboard instrument is formed with circuit electronics for generating polyphonic music, and has internal wiring that provides a plurality of normally open circuit loops. Each circuit loop includes a pair of connector output terminals for closure of the loop. The circuit electronics is responsive to closure of the loops for generating a note or chord. The remote control unit is separate and external from the instrument, but is selectively connected to the instrument by a multi-lead cable; the unit includes multiple connector inputs and a plurality of switches. Each switch is wired between at least a pair of the connector inputs for remote control of the chord-generating function of the keyboard instrument. Six rocker-type foot pedals are preferred, each of which is connected to two switches, so that twelve chords may be easily generated with one of the musician's feet. Operation of controls on the remote unit with a musician's foot enables the musician to play a chord accompaniment while the musician simultaneously plays notes on a lead instrument with one or both hands. Hence, a musican or composer can have the benefit of accompaniment without the burden of identifying and gathering others who are willing and able to help with suitable accompaniment.

3 Claims, 5 Drawing Sheets

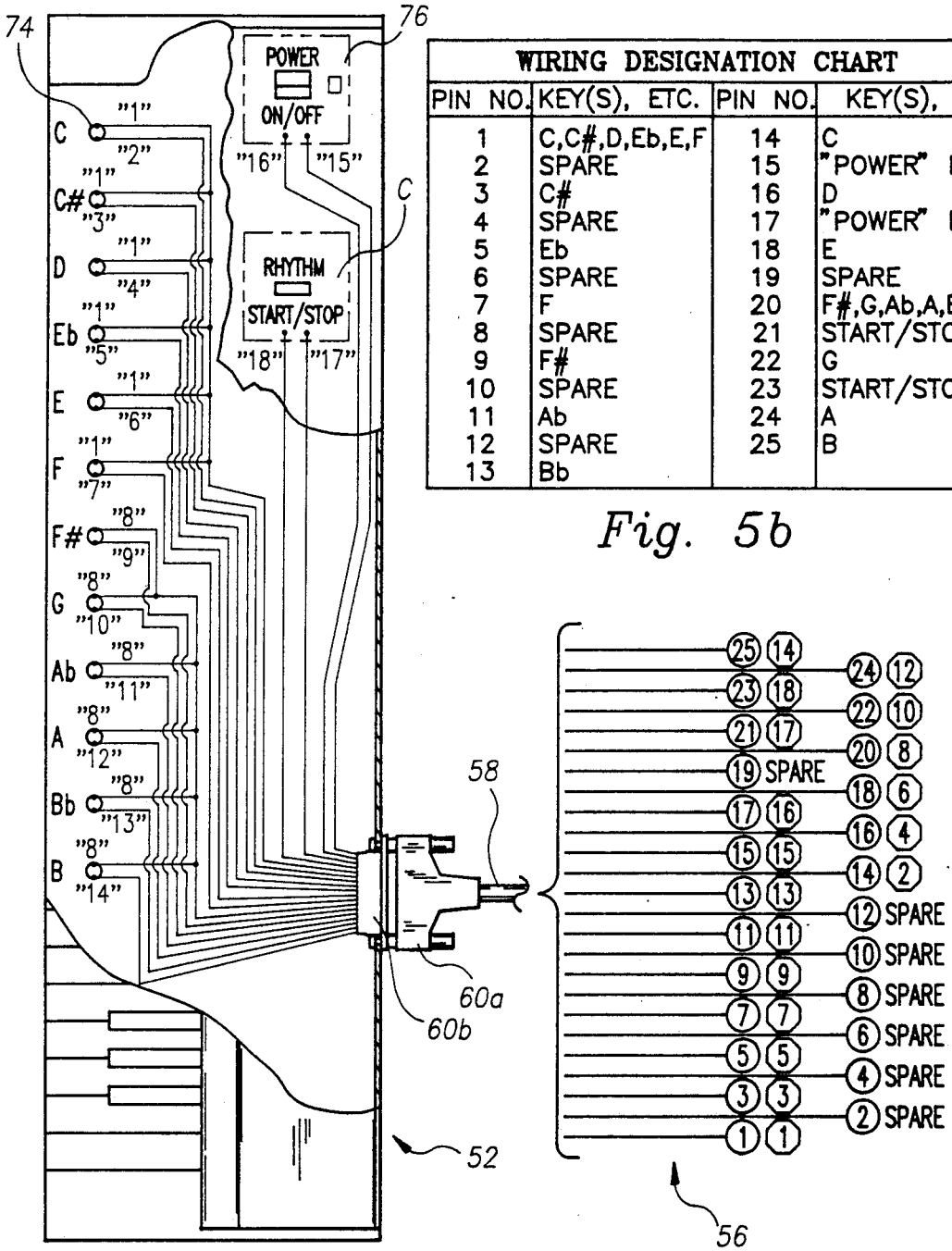
Fig. 5a
| WIRING DESIGNATION CHART | | | |
|---|---|---|---|
| PIN NO. | KEY(S), ETC. | PIN NO. | KEY(S), ETC. |
| 1 | C,C#,D,Eb,E,F | 14 | C |
| 2 | SPARE | 15 | "POWER" LIGHT |
| 3 | C# | 16 | D |
| 4 | SPARE | 17 | "POWER" LIGHT |
| 5 | Eb | 18 | E |
| 6 | SPARE | 19 | SPARE |
| 7 | F | 20 | F#,G,Ab,A,Bb,B |
| 8 | SPARE | 21 | START/STOP |
| 9 | F# | 22 | G |
| 10 | SPARE | 23 | START/STOP |
| 11 | Ab | 24 | A |
| 12 | SPARE | 25 | B |
| 13 | Bb | | |
Fig. 5b
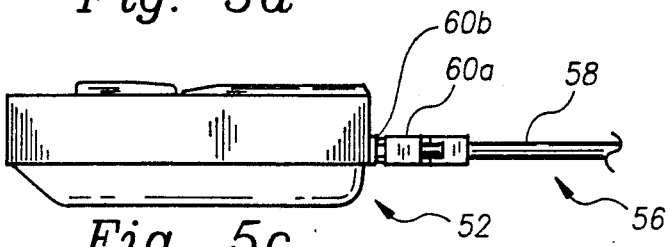
Fig. 5c

FOOT PEDAL OPERATION OF AN ELECTRONIC SYNTHESIZER

BACKGROUND OF THE INVENTION

This invention relates generally to the use of an electronic synthesizer for generating polyphonic music, in conjunction with a primary lead instrument such as a guitar; more particularly, it relates to a method and apparatus for controlling such a synthesizer with a foot-operated control, thereby enabling a musician to use one of his or her feet to generate chords with the synthesizer while playing the lead instrument with one or both hands.

Musicians frequently experience occasions when others are not available to provide accompaniment that is desirable or necessary for composing, rehearsing and even performance. Of course, sometimes it is a musician's preference to practice or compose in solitude; but when accompaniment is desired, such may not be practical, convenient or available. For example, backup music may be needed for only short and unpredictable time intervals during a prolonged practice session. Unless they are well-paid for their time, backup musicians may be reluctant to participate in such practice sessions; and even the most talented of musicians find relatively few friends willing to sit through lengthy segments of a practice session in order to provide only a few moments of accompaniment.

It is true that persons who play instruments requiring the use of both hands (e.g., the guitar, banjo, violin or saxophone) can record a desired accompaniment and play it back on demand, assuming that they are skilled in playing more than one instrument. This merger of recorded music and live music with an instrument of choice can sometimes provide the solo musician with at least a partial sense of how the primary instrument will sound when played with live accompaniment. On the other hand, if the lead or background accompaniment is not fixed in final form, a recording will be unsuitable for experimentation, i.e., for playing altered versions of a composition. Moreover, unlike live musicians, tape recorders and the like are not responsive to requests to repeat certain measures or to modify tempo or volume.

Hence, there has been a sustained need for a solution that permits the player of a primary instrument to be accompanied with music that is totally under the control of that same player-especially when the primary instrument requires the use of both hands. This need can now be satisfied with an accessory device providing, among other features, a foot control means for electronic accompaniment. With suitable wiring or hardware connecting the accessory device to an electronic instrument, the musician can personally develop or rehearse a desired chord backup at the same time that the primary instrument is being played. Thus, the player of the lead instrument can have real time control over his or her accompaniment, making it possible to easily repeat segments or create enhancements to a composition.

Of course, foot pedals are well known in the art for providing certain types of music. Percussionists routinely employ foot controls in order to strike drums or cymbals; organs incorporate pedals for bass notes; and the "one-man band" in many variations has included combinations of foot pedals, cables and levers to play multiple instruments and provide an ensemble that could not otherwise be generated with a single pair of hands. Notwithstanding these developments, there has not heretofore been a system comprising an electronic synthesizer and a foot control with which a solo musician can enjoy playing a primary instrument while at the same time selecting chords for simultaneous accompaniment.

Foot pedals have also been employed in advanced designs of electronic instruments such as the one disclosed in U.S. Pat. No. 4,658,690 to Aitken et al., entitled "Electronic Musical Instrument," which describes an instrument utilizing a foot pedal to modify music that is generated by other parts of the instrument, e.g., varying the decay rate or sustaining the duration of certain tones. The Aitken instrument, although versatile, clearly does not meet the needs of the solo musician or composer who simply wants to provide backup music for a primary instrument. The present invention adapts equipment of modest price to enable the amateur to practice and entertain independently of others. More generally, there is now a simple, economical and practical means for a musician to play non-programmed accompaniment with a lead instrument, even though the musician may not be skilled in playing a keyboard instrument.

BRIEF DESCRIPTION OF THE INVENTION

According to the invention there is provided a chord-generating synthesizer system that is operable by a musician's foot while the musician is simultaneously playing an instrument with his or her hands. Most generally, the system comprises an electronic instrument and a remote control unit that is separate and external from the instrument. The electronic instrument is formed with circuit electronics for generating polyphonic music and wiring means connected to the electronics for providing a plurality of normally open circuit loops. Each circuit loop includes a pair of connector output terminals for closure of the loop. The circuit electronics is responsive to closure of the loops for generating a note or chord. The remote control unit includes multiple connector inputs and a plurality of remote control switches. Each switch is wired between at least a pair of the connector inputs for remote control of instrument operation.

In one embodiment of the invention, the electronic instrument includes a housing with the circuit electronics and wiring means positioned therein. Electrical coupling means are mounted along the instrument housing and connected with the instrument wiring means for extending the open circuit loops outward from the housing for circuit closure by switches of the remote control unit. The coupling means comprises multiple connector outputs. Each connector output provides electrical contact with at least one circuit loop and is available for connection to a connector input of the remote control unit. Closure of one or more circuit loops through the electrical coupling means will effect remote generation of a plurality of the notes—to provide a musical chord.

By way of example, the remote control unit may include a portable housing with multiple foot pedals, each connected to the housing for reciprocal movement. A plurality of switches are mounted within the housing, and each switch is responsive to movement of a foot pedal. Pairs of connector input terminals are mounted along the control unit housing for cable connection with pairs of connector output terminals from the electronic instrument. With each switch coupled to selectively provide electrical connection between a pair of the connector inputs, this arrangement extends control of each open circuit loop to the remote control unit.

According to a method described herein, operation of controls on the remote unit with a musician's foot enables the musician to play a chord accompaniment while the musician simultaneously plays notes on a lead instrument with one or both hands. Using this method, a musician who plays as a hobby—simply for personal entertainment—can have the benefit of accompaniment without the burden of identifying and gathering other musicians who are willing and able to help the musician with suitable accompaniment.

Having briefly described the essence of this invention, it will probably be useful at this time to point out one more thing about the prior art, viz., the more a person knows about synthesizers, the less likely he or she would be to think in terms of using a foot pedal to control a synthesizer. This is because one of the most important parameters that is considered by a musician when comparing one synthesizer with another is the "feel" of the keyboard. The term "feel" is, of course, just a short-hand way of referring to the touch-sensitivity of the instrument. The subject of touch-sensitivity has been addressed by writers such as Jim Aikin who have contributed significant articles to publications like *Keyboard Magazine*; and many of the better articles from that magazine have been republished in book form by the editors. What appears to be a reasonably thorough history of the development of synthesizers can be found in *Synthesizer Basics*, published in 1984 by the editors of *Keyboard Magazine* as Volume 1 in the Keyboard Sythesizer Library.

In the literature about touch-sensitivity of keyboards, it will be found that there is not yet unanimity among keyboard players and the designers who cater to them. Some players apparently prefer force (or pressure) sensitivity, while others prefer velocity sensitivity. With force sensitivity, a depressed key initially acts much like an on-off switch. But after the depressed key has reached the bottom of its excursion, a change in the generated tone can be effected by pressing harder—which activates a pressure sensor under the key. With a velocity-sensitivity system, a sensor determines how fast a key is descending while it is still in motion; once a key has bottomed out on the bed, no further change in tone can take place. And because some musicians prefer one rather than the other, some sophisticated synthesizers have both sensitivity systems, allowing the owner to choose which is to used. It is believed that the importance of "feel" or touch-sensitivity to a professional musician who is playing a synthesizer is reportedly so great as to almost make it ludicrous to suggest to such a person that a foot pedal might be used with a synthesizer. This is because most everyone would agree that humans have much more tactile feeling in—and more control with—their fingers than they do with their feet. And realistically, it is not the purpose of this disclosure to suggest that a musician could expect to substitute toes for fingers (on a one-for-one basis) and achieve an equivalent level of performance over the full length of a synthesizer keyboard. Rather, a major purpose of this disclosure is to disclose the advantage of using foot pedals for the sole purpose of obtaining chords from a synthesizer—to complement other music that is being produced by a musician.

BRIEF DESCRIPTION OF THE FIGURES OF THE DRAWING

FIG. 5*a* schematically illustrates the wiring of chord control keys to a connector assembly;

FIG. 5*b* summarizes the wiring and pin connections of FIG. 5*a*;

FIG. 5*c* is an end view of an electronic instrument of the keyboard variety, as shown in FIG. 5*a*;

DETAILED DESCRIPTION OF A PREFERRED EMBODIMENT OF THE INVENTION

Figure 1:
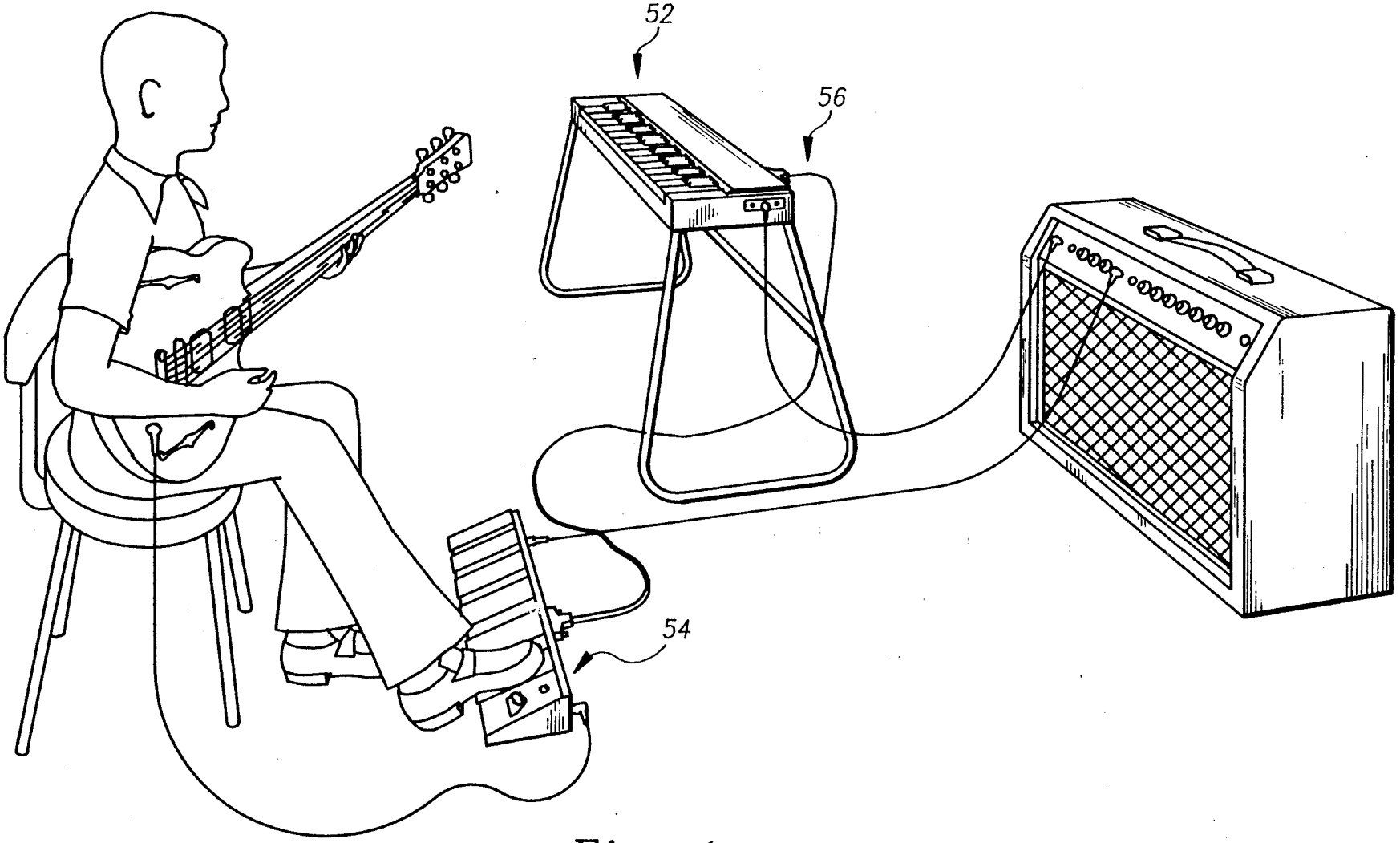
FIG. 1 illustrates generally the arrangement of a musician playing a hand-held instrument (namely, a guitar) while operating a foot-controllable chord synthesizer system according to the invention.

With initial reference to FIG. 1, there is illustrated an arrangement in which a solo musician is simultaneously rehearsing with an electric guitar (or other hand-held instrument) and a chord synthesizer system 50. According to the preferred embodiment of the invention, the synthesizer system 50 comprises an electronic instrument 52 of the keyboard variety, similar to many such instruments of the prior art, interfaced with a new remote control foot pedal assembly 54. A connector assembly 56 connects input terminals of the foot pedal assembly 54 with output terminals associated with internal circuitry of the electronic instrument 52. This connection enables the musician to remotely operate the instrument 52 in a manner that was not previously possible. That is, the musician is able to use one of his feet to generate any of several preselected musical chords—while simultaneously playing the guitar with both hands.

Figure 2:
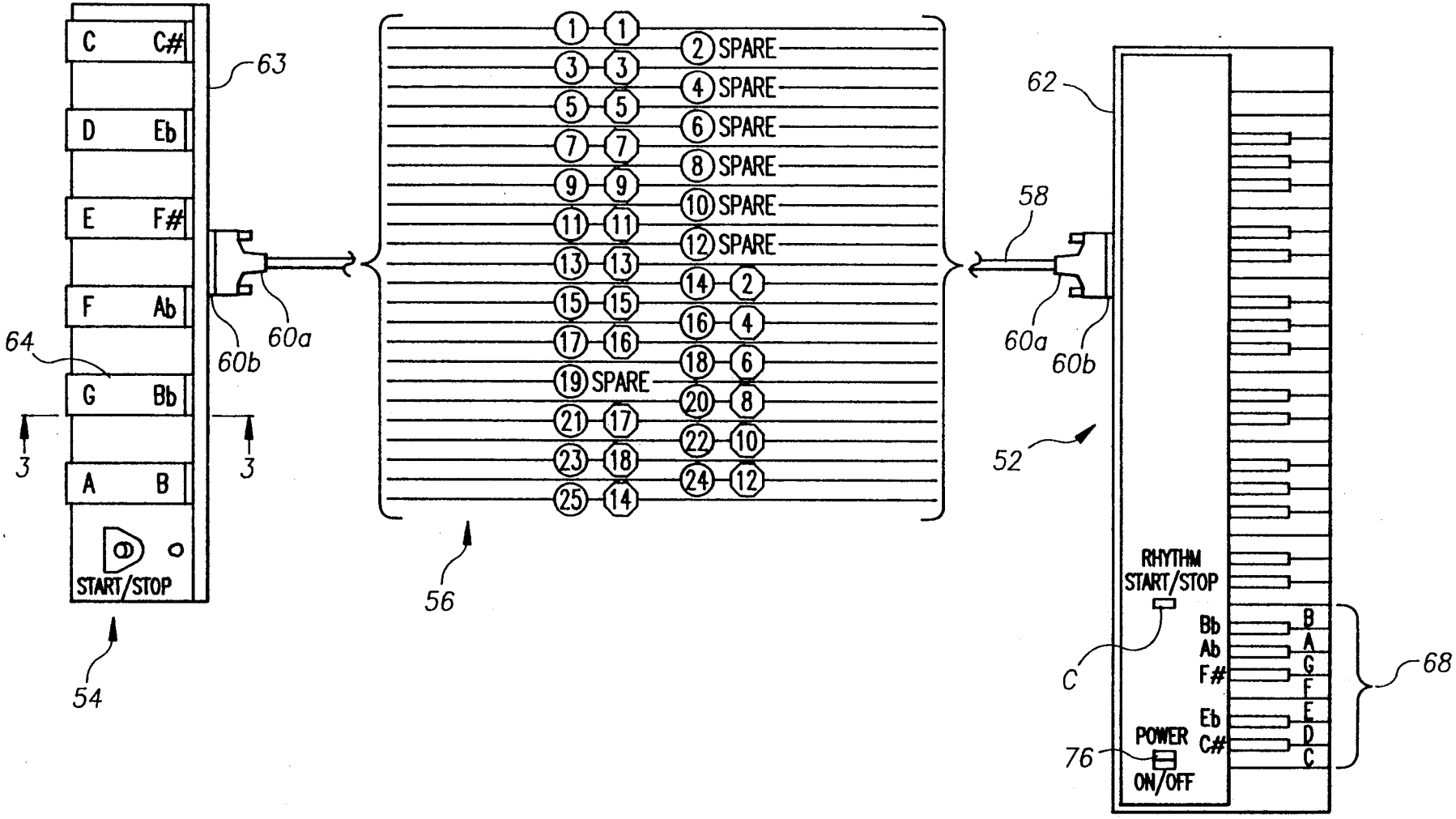
FIG. 2 is a plan view schematically illustrating a simple and preferred embodiment of the synthesizer system shown in FIG. 1.

FIG. 2 schematically illustrates the basic arrangement of the synthesizer system 50 for a simple embodiment of the invention. Various configurations for a flexible cable, as well as the input and output pin connections, can be used to interface terminals of the pedal assembly 54 with those of the instrument 52. As illustrated in the figures, the connector assembly 56 can be readily formed with a common, off-the-shelf, multi-lead RS-232 cable 58 having standard 25-pin male connectors 60*a* at each end and an overall length of at least several feet. Female (socket) connectors 60*b* which mate with the connectors 60*a* at each cable end are mounted, respectively, on the housing 62 of the keyboard instrument 52 and on the housing 63 of the pedal assembly 54. Throughout the illustrations, the mating socket and pin connectors (60*a*, 60*b*) have identical pin numbers designated by circled reference numerals ranging from 1 to 25. Wiring is pin-to-socket identical among all of the mating connectors 60*a*, 60*b*. Also throughout the illustrations, individual wire leads of the connector assembly are designated by reference numerals in octagons.

For the embodiment of FIG. 2, fewer than the twenty-five leads in the RS-232 cable 58 are needed to effect remote control of the instrument 52; and not all of the connector pins are utilized. This is because the illustrated keyboard instrument is of the type that is pre-wired to operate in a chord mode, during which each key in the lowest octave operates to generate a major chord. For example, the lowest (left-most) key that sounds the "C" note during normal keyboard operation will generate a "C major" chord during the chord mode. More generally, the instrument 52 comprises at least twelve chord control keys 68 as commonly provided on a variety of keyboard synthesizers, including the Model MT-800 manufactured by Casio Electronics, as well as synthesizers made by other companies. With this pre-wired configuration, the foot pedal assembly 54 can be interfaced to a Casio instrument 52 with a small number of added connections.

According the invention, an after-market interface kit can be developed for keyboard instruments such as the Casio MT-800 to provide the solo musician with remote chord control through a pedal assembly 54. The pedal assembly 54 includes a cluster of six, three-position, rocker-type foot pedals 64. The six foot pedals may be used to generate up to twelve chords, by letting the center position of a pedal serve as an "off" position, and letting the forward and rear positions serve to generate a given chord. In this simple embodiment, the twelve available chords correspond to the same twelve chords available from the twelve keys 68 when the instrument 52 operates in the chord mode.

Figure 3:
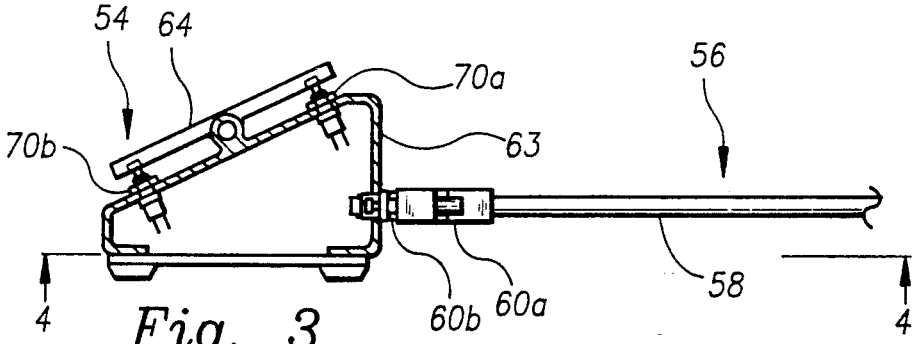
FIG. 3 is a partially complete cross-sectional view of a foot pedal assembly taken in the plane represented by lines 3—3 of FIG. 2.

Each pedal 64 serves as a three-position control and, unless depressed by the musician's foot, will be biased to a center resting position by virtue of a captured spring. FIG. 3 shows a cross-sectional view of the foot pedal assembly 54 taken in the plane indicated by lines 3—3 of FIG. 2, with certain wiring and circuitry being omitted (for clarity); this view illustrates one of the six rocker-type foot pedals 64 in greater detail. Each foot pedal 64 can be displaced in either of two opposing directions with respect to the center position, to close one of two switches 70*a*, 70*b* and thereby generate a different one of two preselected chords. These chord-change switches 70*a*, 70*b* are of the normally open, push-on variety such as Radio Shack No. 275-1547. Thus, a compact cluster of six pedals 64 can reliably activate a total of twelve switches 70*a*, 70*b*, each of which is "external" to the instrument 52 and not originally designed to be a part of the instrument as it was manufactured and sold. Each switch 70*a*, 70*b* is wired for connection to the keyboard instrument 52 in order to remotely select a different musical chord.

Figure 4:
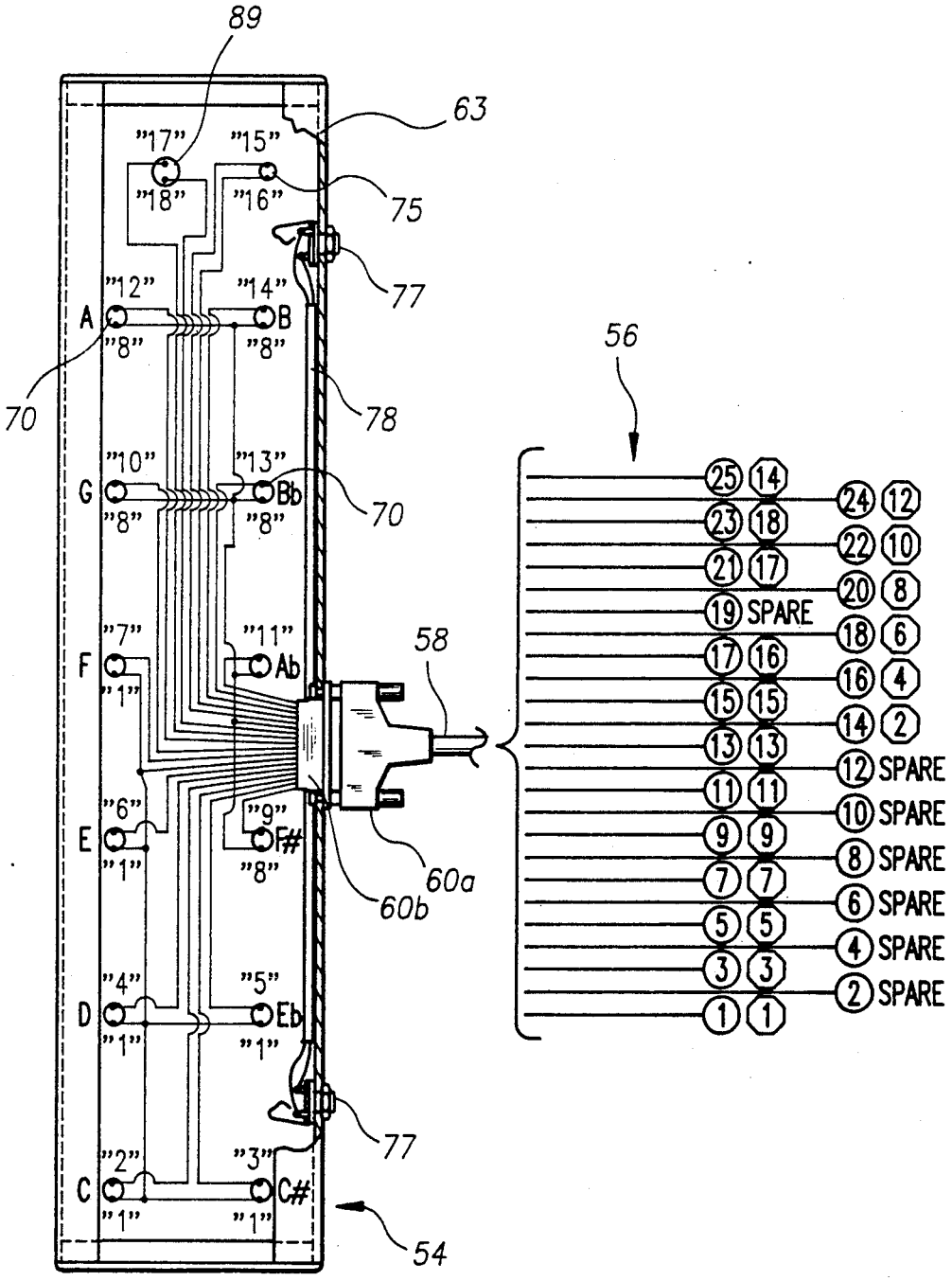
FIG. 4 is a bottom view of the foot pedal assembly taken in the plane represented by the lines 4—4 of FIG. 3.

Throughout the figures, corresponding wire leads of both the keyboard instrument 52 and the pedal assembly 54 are designated in quotation marks with the same number as the respective, corresponding wire leads of the cable 58 through which they are connected. The wiring diagram of FIG. 4 illustrates a basic circuit arrangement for the new pedal assembly 54, as well as pin connections between each of the twelve switches 70 and the connector assembly 56. Wire and pin connections from the connector assembly 56 to the original equipment manufacturer (OEM) circuit electronics 72 of the twelve chord keys 68 is illustrated in part with schematic wiring in the cut-away view of FIG. 5*a*. The keys 68 (FIG. 2) that operate with the OEM circuit electronics 72 to generate chords are depicted in FIGS. 4 and 5*a* as a series of mechanical key switches 74.

Regardless of whether the instrument 52 is operating in the normal keyboard mode or the chord mode, the two wire leads connected to each key switch 74 are terminals of an open circuit loop for activating the circuit electronics 72. When the loops are closed by operation of the key switches 74, the electronics generate electrical signals of predetermined audio frequencies corresponding to desired notes or chords, depending on the mode of operation. In the chord mode, each key 68 (on the keyboard of instrument 52) is wired to simultaneously close a set of open circuit loops. Thus, operation of the instrument is responsive to movement of the key switches 74 to generate electrical signals of differing audio frequencies; and in the chord mode, individual movement of the keys 68 simultaneously generates multiple audio frequencies to provide a musical chord.

Wiring in the remote control foot pedal assembly 54 couples each foot pedal switch 70*a*, 70*b* in parallel with one keyboard switch 74, in order to selectively close at least one open circuit loop in the electronics 72. Pin connections to the keyboard wiring are summarized in the wiring designation chart of FIG. 5*b*.

To further illustrate the principle of the invention, the wiring to effect remote generation of one chord with the foot pedal assembly 54 will now be described. According to the illustrated embodiment, the switch 70*b* of the left-most pedal 64 remotely controls generation of the "C" chord when the keyboard instrument is operating in the chord mode. As shown in FIG. 4, a foot pedal switch 70 connects wires "1" and "2" of the foot pedal assembly 54, which in turn are wired to socket numbers 1 and 14 of the chassis mounted RS-232 female connector 60*b*. Referring also to FIG. 5, each of the wires "1" and "2" is connected through a respective cable lead 1 or 2 and through a keyboard instrument wire lead "1" or "2" to a key switch 74, thereby providing a parallel arrangement between the foot pedal switch 70*b* for the "C" chord and the key switch 74 for the "C" chord.

Similar arrangements are provided for the other eleven chords controlled by the pedal assembly 54. It should be noted that multiple pedal switches 70*a*, 70*b* can have one terminal connected in common, as designated in the wiring chart of FIG. 5*b*. For example, pin 1 is connected through wire 1 of the pedal assembly to those pedal switches 70*a*, 70*b* which control the chords C, C♯, D, E$^b$, E and F. Similarly, pin 2 is connected through wire "8" of the pedal assembly to those pedal switches 70*a*, 70*b* which control the chords F♯, G, A$^b$, A, B$^b$ and B.

With reference to FIGS. 4 and 5*a*, the foot pedal assembly 54 also includes an indicator light 75 connected through wires "15" and "16" and socket numbers 4 and 15 to the power switch 78 on instrument 52. This light provides visual confirmation that the instrument 52 is powered up and that the remote control assembly 54 is operably connected to generate a chord upon closure of an external switch 70*a*, 70*b* with a foot.

FIG. 4 further illustrates accessory cable routing in the foot pedal assembly 54 to accommodate any electronic wiring that may be associated with the lead instrument, e.g., an electric guitar requiring connection to an amplifier. Standard ¼" open circuit type phone jacks 77 are mounted in the housing 63 at each end of the pedal assembly 54, and are connected with a segment of shielded phone cord 78 internal to the assembly 54. The musician can use this cable routing to connect the guitar wiring through the housing 63, so that the foot controls can be selectively positioned in front of the musician to both suit the personal preference of the musician and avoid obstructions between the pedal assembly 54 and the lead instrument. For example, without the accessory cable routing, an amplifier cord may likely cross over the pedal assembly 54 and interfere with operation of the assembly.

MODIFICATIONS AND ADVANTAGES

The embodiment described assumes a synthesizer or other instrument 52 that is designed to produce chords and is normally intended to be played directly from the keyboard. This invention contemplates the addition, either as a manufacturer's option or as a user modification, of the necessary wiring interface for adding a foot pedal assembly 54 to provide remote operation of the chord function. More simply, the invention can be implemented with any chord synthesizer, e.g., a chord organ, which generates dedicated or preprogrammed chords by depressing individual keys or buttons. A more basic version of the same embodiment would constitute a chord synthesizer dedicated for use with only the foot pedal assembly 54. That is, a special synthesizer could be manufactured without the customary keyboard or any chord buttons for manual control. In the absence of manually depressed keys, such a special synthesizer would be controlled only by a foot pedal assembly 54 as described above for the preferred embodiment.

On the other hand, it is also contemplated that more complex wiring arrangements could be implemented with the concepts already disclosed herein, using preprogrammed chord keys of an electronic instrument. When an instrument 52 is in the normal note-playing keyboard mode instead of the chord mode, the foot control pedal assembly 54 can be programmed independently of any existing chord control keys to generate any desired set of chords. That is, a more complex wiring arrangement can be employed to wire together several of the key switches 74, each corresponding to a different note in a desired chord, in parallel with a single switch 70 on the foot pedal assembly 54. This more general approach, which will hereinafter be referred to as the musician-programmable embodiment, would enable a musician to program a given foot pedal switch 70 to generate any one of many possible chord combinations, e.g., major, minor, augmented sixth and diminished seventh.

One configuration of the musician-programmable embodiment would wire all of the key switches 74 through programming switches (not illustrated) for selective and simultaneous connection in parallel with multiple pedal switches 70; and the musician would set the programming switches to select and place the notes in a desired chord under the control of a particular switch 70. With the exemplary pedal assembly 54, the musician could program as many as twelve chords in order to provide accompaniment, or for experimentation, when preparing a new composition. This configuration could be implemented with semiconductor integrated circuitry. For example, the switches can be an array of programmable field effect transistors; and a variety of programmed configurations can be stored in memory.

It would also be convenient for a user to program a microprocessor with menu-driven software to enable the musician to select, and perhaps store on magnetic media, a series of chords for each of several arrangements. This approach could be implemented at modest cost with a simple four-bit computer controller, with ROM and RAM requirements each less than 256K bytes and with a small LCD display.

Alternately, this same function could be implemented without integrated circuitry. For example, a programmable wiring box (not illustrated) could be positioned next to the instrument 52, and the pedal assembly 54 could be configured to program each foot pedal switch 70 to generate a desired chord. The wiring box would include a plurality of open circuit loops, each in parallel with a different key switch 74 and connectable (as with two-connector phone jacks) to any one or more of the pedal switches 70 to control closure of a loop.

A less elaborate musician-programmable embodiment would include wiring, internal or external of the instrument 52, for activating preselected combinations of notes in order to make available a limited number of chords. For example, the wiring could make all major and minor chords available. The musician would then control various DIP switches to program any twelve of these twenty-four chords for control by the pedal assembly 54.

Figure 6:
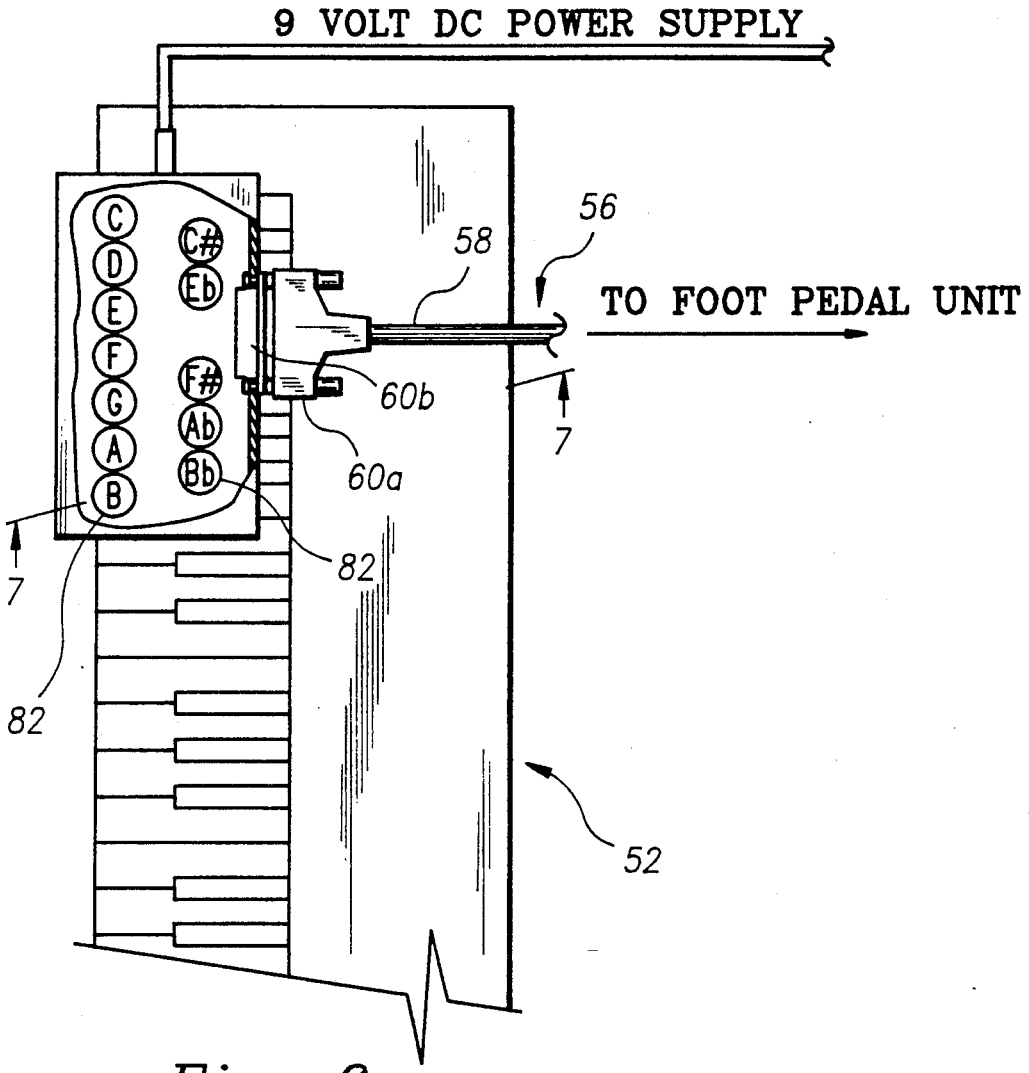
FIG. 6 illustrates an alternate embodiment of the invention, comprising a solenoid interface for operating the keyboard of an electronic instrument with a remote control foot pedal.
Figure 7:
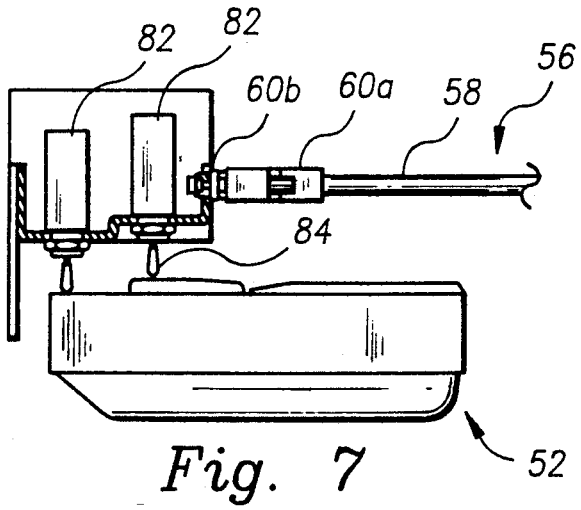
FIG. 7, taken along lines 7—7 of FIG. 6 is a cross-sectional view of the solenoid-operated interface.

According to another embodiment of the invention, a foot pedal assembly 54 can be interfaced with the keyboard instrument 52 through a solenoid actuated pad 80. As shown in the plan view of FIG. 6, the pad 80 can be mounted over the chord keys 68 such that each of twelve DC tubular solenoid actuators 82 is positioned in such a way as to enable it to depress one of the keys 68. For the pair of solenoid actuators 82 shown in the cross-sectional view of FIG. 7, each actuator comprises a plunger or extendible member 84. Energization of a solenoid can be remotely controlled by a foot pedal switch 70, to selectively depress a chord control key 68, thereby closing a key switch 74 (shown in FIG. 5*a*). Suitable solenoid actuators are model No. M-190-29-H, manufactured by the Shindengen Co. of Tokyo, Japan and marketed in the United States by the E-M Division of Densitron Corporation in Troy, Ohio. These actuators 82 can be powered with a standard nine volt DC supply and coupled to the foot pedal assembly 54 with the connector assembly 56 in the manner already described with respect to the embodiment of FIGS. 2, 4 and 5*a* and 5*c*. A soft tip should be attached to the extendible shaft member 84 to prevent damage to the instrument keys 52.

From the above, it should be apparent that the invention provides a single musician with improved ability to compose background and lead melodies, to experiment and to rehearse with the chord synthesis under complete control of that musician. The great flexibility and convenience that can be realized through various embodiments of the synthesizer system will provide a cost and time savings to both amateurs and professionals alike. One major benefit is the elimination of any difficulty that a musician might have in communicating to an accompanist exactly what he or she is looking for in performing a particular piece. When the same brain is controlling both the lead and the accompaniment, there can be no misunderstanding about what is wanted and when. Moreover, according to the illustrated embodiment, provision of the foot control assembly is a user option. That is, the remote control assembly is a portable unit designed for physical and electrical disconnection from the synthesizer. These features improve rather than limit the versatility of the synthesizer instrument 52. For example, when forming a synthesizer system with an electric piano, a chassis-mounted connector such as the RS-232 connector 60*b* is secured to the instrument housing so that the musician or others could use the piano as a stand-alone keyboard. On other occasions, a musician can easily connect the remote control foot pedal assembly 54 to the electric piano to serve individual needs. Thus, instrument manufacturers could sell basic versions of their keyboard models that include the necessary wiring and connector output terminals for forming a system 50. An owner of a basic instruments could later purchase the foot control assembly as an add-on option. And because the foot-control assembly may be separated at will from the synthesizer, a given musician might own one foot pedal unit for ten years while owning a succession of synthesizers during the same period-each being more sophisticated than its predecesor (and probably more expensive), and each being used in tandem with the same assembly 54.

Keyboard synthesizers that operate in the chord mode often include rhythm sections. The same principles disclosed herein can be applied to extend parallel circuits from the instrument in order to remotely control the generation of rhythms. Generally, it is possible to use the assembly 54 to remotely control any features of the synthesizer, such as a volume control or and intro-fill-in feature that pauses the rhythm section and places the "drummer" in a fill-in mode.

Although only certain embodiments of the invention have been disclosed herein in detail, numerous modifications and refinements will be apparent to those skilled in the art. For example, the foot pedal assembly 54 has been depicted as comprising a plurality of rocker-type pedals 64 that are mechanically linked with the switches 70 for pivotal movements. This arrangement can be replaced with a foot-control assembly comprising footprint pads formed over pressure switches. It is also contemplated that linking of the external switches 70 in the foot-control assembly with the keyboard instrument circuit electronics 72 may be accomplished without the connector assembly. In fact, the switches 70 could actuate an infrared or radio frequency link that would control operation of additional switches in the instrument 52—to close certain circuit loops in the electronics 72. For specialized applications, the system 50 could be formed as a single, stand-alone package, i.e., not requiring the connector assembly 56. Such electronics could even be integrated with a guitar amplifier. An optional on/off switch (for the keyboard synthesizer) can also be advantageously placed on the foot control unit, so that a musician can turn the synthesizer on and off while sitting some distance from the instrument. An indicator light may be coupled to the on/off switch, to provide visual confirmation that the synthesizer is powered. In view of the other embodiments and modifications that will no doubt be apparent to persons skilled in the art, it should be appreciated that the invention should be deemed to be limited only by the scope of the claims that follow.

What is claimed is:

1. A remote control unit operable by movement of a musician's foot and being compatible for use in conjunction with an electronic keyboard instrument, said instrument having a plurality of keys on the upper surface of a housing that are operatively connected to switches within the housing, and the instrument being responsive to movement of said keys to generate electrical signals of differing audio frequencies, with individual movement of at least some of said keys simultaneously generating multiple audio frequencies to provide a musical chord, said remote control unit comprising:

a. a foot control assembly that is separate and apart from the keyboard instrument, said assembly including six rocker-type foot pedals and an external switch associated with each end of the six foot pedals, each of the six foot pedals being mounted for rotation about a central pivotal axis so as to selectively close either one of its two external switches, and each foot pedal maintaining both of its two associated switches in an open position when the foot pedal is released by the musician's foot and is allowed to return to a neutral position; and b. means for forming a parallel electrical connection between each of the switches of the foot control assembly and at least one of the chord-generating keys on the keyboard instrument, such that any desired one of twelve chords may be generated by a musician either by manual movement of a key on the electronic instrument's keyboard or closure of an external switch with a foot, said means including a manually separable connector assembly for physically and electrically separating the foot control assembly from the electronic keyboard instrument, such that the electronic keyboard instrument may be rendered non-responsive to closure of an external switch at a desired time, and said manually separable connector assembly including a multi-lead cable and a first pair of separable mating connectors, the first one of the pair of mating connectors being electrically coupled to the multi-lead cable, and the second one of the pair of mating connectors being mounted on the foot control assembly and being electrically connected to the external switches that are responsive to movement of the musician's foot.

2. A chord-generating synthesizer system for use by a musician while simultaneously playing an instrument normally requiring use of both of the musician's hands, said system comprising an electronic instrument and a remote control unit separate and external from said instrument, and wherein the electronic instrument is formed with circuit electronics for generating polyphonic music, comprising:

a. a first housing having positioned therein the circuit electronics and a wiring means that is connected to said circuit electronics for providing a plurality of normally open circuit loops, each of said loops including a pair of connector output terminals for closure of the loop, and each loop being capable of electronically generating at least one note when closed; and b. said remote control unit including a second housing and a plurality of pairs of connector input terminals mounted along the housing for connection with pairs of connector output terminals of the electronic instrument to extend each open circuit loop to the remote control unit, and further including a plurality of switches and six foot pedals arranged side by side and pivotally mounted on the housing for reciprocal movement with respect to the plurality of switches, and each of the pedals being associated with two of said switches, and each switch being coupled to selectively provide electrical connection between a pair of the connector input terminals and a pair of the connector output terminals, such that a total of twelve normally open circuit loops may be selectively closed by use of six foot pedals in the remote control unit.

3. The chord-generating synthesizer system as claimed in claim 2 wherein each switch in the remote control unit is coupled to selectively provide electrical connection between a pair of the connector input terminals and a pair of the connector output terminals with a multi-lead flexible cable having two ends, and both of its two ends being terminated with RS-232 connectors.

* * * * *